US006684417B1

(12) United States Patent
Schneider

(10) Patent No.: US 6,684,417 B1
(45) Date of Patent: Feb. 3, 2004

(54) VENTED TOILET PLUNGER

(76) Inventor: Wallace Schneider, 41 W. 72nd St., #8A, New York, NY (US) 10023-3483

( * ) Notice: Subject to any disclaimer, the term of this patent is extended or adjusted under 35 U.S.C. 154(b) by 60 days.

(21) Appl. No.: 10/152,481

(22) Filed: May 21, 2002

(51) Int. Cl.[7] ..... E03D 9/00
(52) U.S. Cl. ..... 4/255.12; 4/255.05
(58) Field of Search ..... 4/255.11, 255.12, 4/255.05

(56) References Cited

U.S. PATENT DOCUMENTS 930,236 A * 3/1909 Schacht ..... 4/255.12
2,312,826 A * 3/1943 Leyden ..... 4/255.12
4,622,702 A 11/1986 Allen
4,768,237 A 9/1988 Torti
6,163,895 A 12/2000 Davenport
6,247,190 B1 6/2001 Rigopoulus

* cited by examiner

*Primary Examiner*—Charles E. Phillips
(74) *Attorney, Agent, or Firm*—Richard L. Miller

(57) ABSTRACT

A vented toilet plunger that includes a cup and a handle. The cup has a vent valve assembly that extends through a high point of the cup. The vent valve assembly is a check valve that contains a ball that normally allows communication through the check valve. The ball of the check valve is of a weight that is not overcome by air, but is overcome by water, so as to allow communication through the check valve when the cup is first put into the water so as to allow the air trapped in the cup to be vented out, but once the air is vented out, the water fills the cup and moves the ball of the check valve to block communication through the check valve so as not to allow the water to pass therethrough.

2 Claims, 1 Drawing Sheet

VENTED TOILET PLUNGER

BACKGROUND OF THE INVENTION

1. Field of the Invention

The present invention relates to a toilet plunger. More particularly, the present invention relates to a vented toilet plunger.

2. Description of the Prior Art

Numerous innovations for toilet plungers have been provided in the prior art that will be described. Even though these innovations may be suitable for the specific individual purposes to which they address, however, they differ from the present invention.

A FIRST EXAMPLE, U.S. Pat. No. 4,622,702 to Allen teaches an improved plunger for clearing clogged bathroom drains and the like. The plunger has apertures through the wall of its resiliently collapsible cup and a diaphragm or other occlusion member on the inside surface of the cup for alternately opening and partially occluding the apertures in response to pressures and liquid flow. The invention allows repetitive application of downward hydraulic pressure on the clog without excessive reverse pressures during the intervening upward strokes, facilitates variation in the degree of hydraulic pressure applied, and provides several related advantages. In one preferred embodiment, the diaphragm is secured to a raised portion of the cup Inside surface. In another, the degree of maximum occlusion is adjustable by turning the occlusion member. In yet another, the cup and diaphragm are integrally formed.

A SECOND EXAMPLE, U.S. Pat. No. 4,768,237 to Torti teaches a toilet plunger that comprises a resiliently deformable plunger element, a tubular handle element which is connectable to a supply of pressurized water, a shutoff valve on the handle element, and a check valve element for preventing the inadvertent back flow of fluids through the handle element. The toilet plunger is operable for applying increased pressure to an obstruction in the outlet portion of a toilet or in a drain line by supplying pressurized water to the plunger element through the tubular handle element, and it is alternatively operable as a conventional toilet plunger by positioning the plunger element over the outlet portion of the toilet or drain line and reciprocally moving the handle element toward and away from the plunger element. The check valve element prevents the backflow of fluids through the handle element in the event that the shutoff valve is inadvertently left in an open position when the plunger is reciprocally operated as a conventional toilet plunger.

A THIRD EXAMPLE, U.S. Pat. No. 6,163,895 to Davenport teaches a multi-purpose water pressure plunger having an adjustable valve with a regulating lever that is attached to a handle. The handle is connected to an anti-backflow valve. The anti-backflow valve is removably connected to a plunger head that is made of a soft, pliable material that can easily deform to a desired shape so as to form a seal within a drain or pipe.

A FOURTH EXAMPLE, U.S. Pat. No. 6,247,190 B1 to Davenport teaches a plunger assembly having a plunger portion and an elongated handle with a central bore. The plunger portion has a bottom opening sized for fluid communication with a drain opening. The top end of the plunger portion has a threaded opening sized to receive the threaded end of the elongated handle, and allowing for fluid communication with the central bore. A check valve assembly rests on an annular seat formed inside the bottom of the elongated handle proximate the opening formed in the top end of the plunger portion. The check valve serves to allow airflow into the top end of the plunger portion while preventing airflow out of the top end of the plunger portion to prevent undesired backflow. Further regulation of the air flow into the plunger portion is achieved by providing a cap, at the top of the elongated handle for selectively allowing airflow into and through the central bore. The cap, in cooperation with a rubber gasket, allows for variable control of the amount of air which can enter the central bore and therefore the plunger portion. An adapter element may be used to allow connection of the handle to a conventionally sized threaded plunger portion. A portable carrying case provides a sanitary enclosure which allows for movement of the plunger between rooms with contaminating other rooms with potentially hazardous biological waste and debris.

It is apparent that numerous innovations for toilet plungers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a vented toilet plunger that avoids the disadvantages of the prior art.

ANOTHER OBJECT of the present invention is to provide a vented toilet plunger that is simple and inexpensive to manufacture.

STILL ANOTHER OBJECT of the present invention is to provide a vented toilet plunger that is simple to use.

BRIEFLY STATED, STILL YET ANOTHER OBJECT of the present invention is to provide a vented toilet plunger that includes a cup and a handle. The cup has a vent valve assembly that extends through a high point of the cup. The vent valve assembly is a check valve that contains a ball that normally allows communication through the check valve. The ball of the check valve is of a weight that is not overcome by air, but is overcome by water, so as to allow communication through the check valve when the cup is first put into the water so as to allow the air trapped in the cup to be vented out, but once the air is vented out, the water fills the cup and moves the ball of the check valve to block comunication through the check valve so as not to allow the water to pass therethrough.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows.

LIST OF REFERENCE NUMERALS UTILIZED IN THE DRAWING

Figure 1:
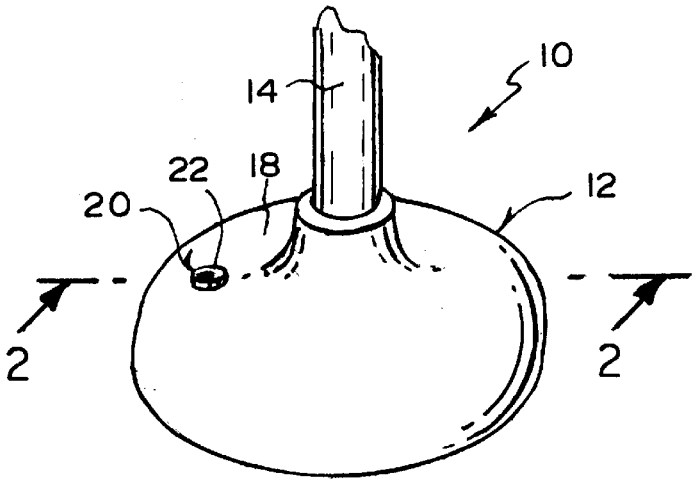
FIG. 1 is a diagrammatic perspective view of the present invention.

10 vented toilet plunger of present invention
12 cup
14 handle
16 vent through bore through high point 18 of cup 12
18 high point of cup 12
20 vent valve assembly
22 check valve of vent valve assembly 20
24 ball contained in check valve 22 of vent valve assembly 20

DESCRIPTION OF THE PREFERRED EMBODIMENT

Referring now to the figures, in which like numerals indicate like parts, and particularly to FIG. 1, the vented toilet plunger of the present invention is shown generally at 10.

The vented toilet plunger comprises a cup 12 that is resiliently collapsible and vented and a handle 14 that extends axially from the cup 12.

The handle is Blender and elongated.

Figure 2:
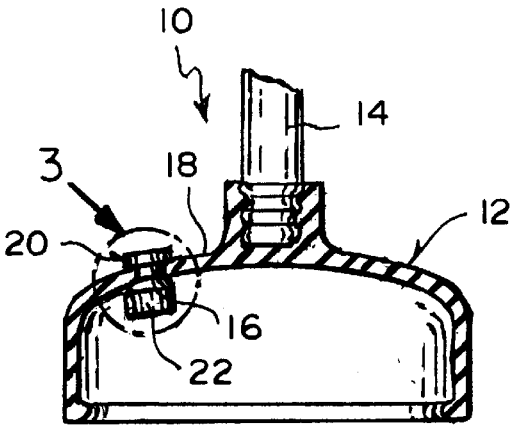
FIG. 2 is an enlarged diagrammatic cross sectional view taken along line 2—2 in FIG. 1

The configuration of the cup 12 can best be seen in FIG. 2, and as such, will be discussed with reference thereto.

The cup 12 has a vent throughbore 16 through a high point 18 thereof and a vent valve assembly 20 that extends through the vent throughbore 16 therein.

Figure 3:
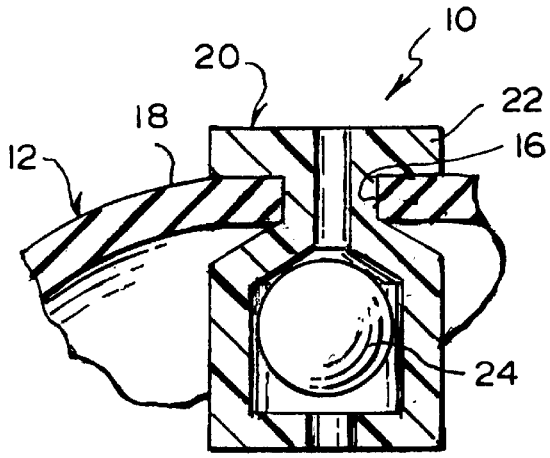
FIG. 3 is an enlarged diagrammatic cross sectional view of the area generally enclosed by the dotted curve identified by arrow 3 in FIG. 2.

The configuration of the vent valve assembly 20 can best be seen in FIG. 3, and as such, will be discussed with reference thereto.

The vent valve assembly 20 is a check valve 22 that contains a ball 24 that normally allows communication therethrough.

The ball 24 of the check valve 22 is of a weight that is not overcome by air, but is overcome by water, so as to allow communication through the check valve 22 when the cup 12 is first put into the water so as to allow the air trapped in the cup 12 to be vented out, but once the air is vented out, the water fills the cup 12 and moves the ball 24 of the check valve 22 to block communication through the check valve 22 so as not to allow the water to pass therethrough.

It will be understood that each of the elements described above, or two or more together, may also find a useful application in other types of constructions differing from the types described above.

While the invention has been illustrated and described as embodied in a vented toilet plunger, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can by applying current knowledge, readily adapt it for various applications without omitting features that, from the standpoint of prior art, fairly constitute characteristics of the generic or specific aspects of this invention.

The invention claimed is:

1. A vented toilet plunger, comprising:

a) a cup; and b) a handle;

wherein said cup is resiliently collapsible;

wherein said cup is vented;

wherein said handle extends axially from said cup;

wherein said cup has a vent throughbore through a high point thereof;

wherein said cup has a vent valve assembly;

wherein said vent valve assembly of said cup extends through said vent throughbore therein;

wherein said vent valve assembly is a check valve;

wherein said check valve contains a ball;

wherein said ball of said check valve normally allows communication through said check valve;

wherein said ball of said check valve has weight; and wherein said weight of said ball is not overcome by air, but is overcome by water, so as to allow communication through said check valve when said cup is first put into the water so as to allow the air trapped in said cup to be vented out, but once the air is vented out, the water fills said cup and moves said ball of said check valve to block communication through said check valve so as not to allow the water to pass therethrough.

2. The plunger as defined in claim 1, wherein said handle is slender; and wherein said handle is elongated.

* * * * *